United States Patent [19]

McNeill

[11] Patent Number: 4,998,681

[45] Date of Patent: Mar. 12, 1991

[54] DISPENSER FOR TOILET ROLLS

[76] Inventor: John D. McNeill, 14 Simla Avenue, Havelock North, New Zealand

[21] Appl. No.: 380,896

[22] Filed: Jul. 17, 1989

[30] Foreign Application Priority Data

Jul. 20, 1988 [NZ] New Zealand ..... 225496
Nov. 24, 1988 [NZ] New Zealand ..... 227076

[51] Int. Cl.[5] ..... B65H 19/00
[52] U.S. Cl. ..... 242/55.53; 242/55.3
[58] Field of Search ..... 312/38; 242/55.2, 55.3, 242/55.53; 206/390, 391; 220/326

[56] References Cited

U.S. PATENT DOCUMENTS 2,510,537 6/1950 Agamaite, Jr. ..... 242/55.3
3,584,802 6/1990 Sieber ..... 242/55.3
4,113,195 9/1978 Theunissen ..... 242/55.3
4,407,459 10/1983 Wormley ..... 242/55.3 X
4,520,968 6/1985 Shpigelman ..... 242/55.3

FOREIGN PATENT DOCUMENTS

3621493A1 1/1988 Fed. Rep. of Germany .

*Primary Examiner*—Daniel P. Stodola
*Assistant Examiner*—Paul Thomas Bowen
*Attorney, Agent, or Firm*—Pasquale A. Razzano

[57] ABSTRACT

A toilet roll dispenser comprising a casing having a loading compartment which has a lid openable to enable a toilet roll to be loaded therein and a dispensing compartment to enable paper to be dispensed from a toilet roll. A locking means is provided to prevent the lid being opened when there is a toilet roll present in the loading compartment. Means is also provided to inhibit a toilet roll being removed from the dispensing compartment until substantially all of the paper has been dispensed from the roll.

5 Claims, 6 Drawing Sheets

DISPENSER FOR TOILET ROLLS

This invention relates to a toilet roll dispenser.

BACKGROUND

Toilet paper for sanitary purposes is generally manufactured either in a roll form or in the form of interleaved sheets packaged in a box. When in roll form, usually called a toilet roll, the paper is of a continuous nature with tear off or break lines at predetermined intervals, the paper being rolled about a central hollow core generally formed of cardboard or the like. In commercial situations such as public toilets, there is often a considerable wastage of the paper, such as when large quantities of paper are removed from the roll. Another problem encountered in such situations, is the theft of the toilet roll itself.

Some of the above problems have been alleviated by the use of the boxes of interleaved sheets with the boxes being housed within substantially tamper proof containers. However the unit cost of each sheet of paper is considerably more than an equivalent amount of paper dispensed from a roll so that the use of boxes of interleaved sheets does not necessarily result in monetary savings.

OBJECT OF THE INVENTION

It is an object of this invention to provide an improved toilet roll dispenser, which seeks to overcome the above disadvantages.

STATEMENT OF THE INVENTION

One form of the invention in broad terms therefore consists of a toilet roll dispenser comprising a casing having a loading compartment and a dispensing compartment, said loading compartment including a lid member openable to enable a toilet roll to be loaded into the loading compartment and including locking means to prevent the lid member from being opened while a toilet roll is present in the loading compartment, said dispensing compartment having a mechanism moveable to a first position to receive a toilet roll from the loading compartment and moveable to a second position to enable paper to be dispensed from the toilet roll, said dispenser also having means to inhibit the removal of the toilet roll from the dispensing compartment until substantially all of the paper has been dispensed from the roll.

DETAILED DESCRIPTION

A preferred form of the invention will now be described in conjunction with the accompanying drawings, wherein.

Figure 1:
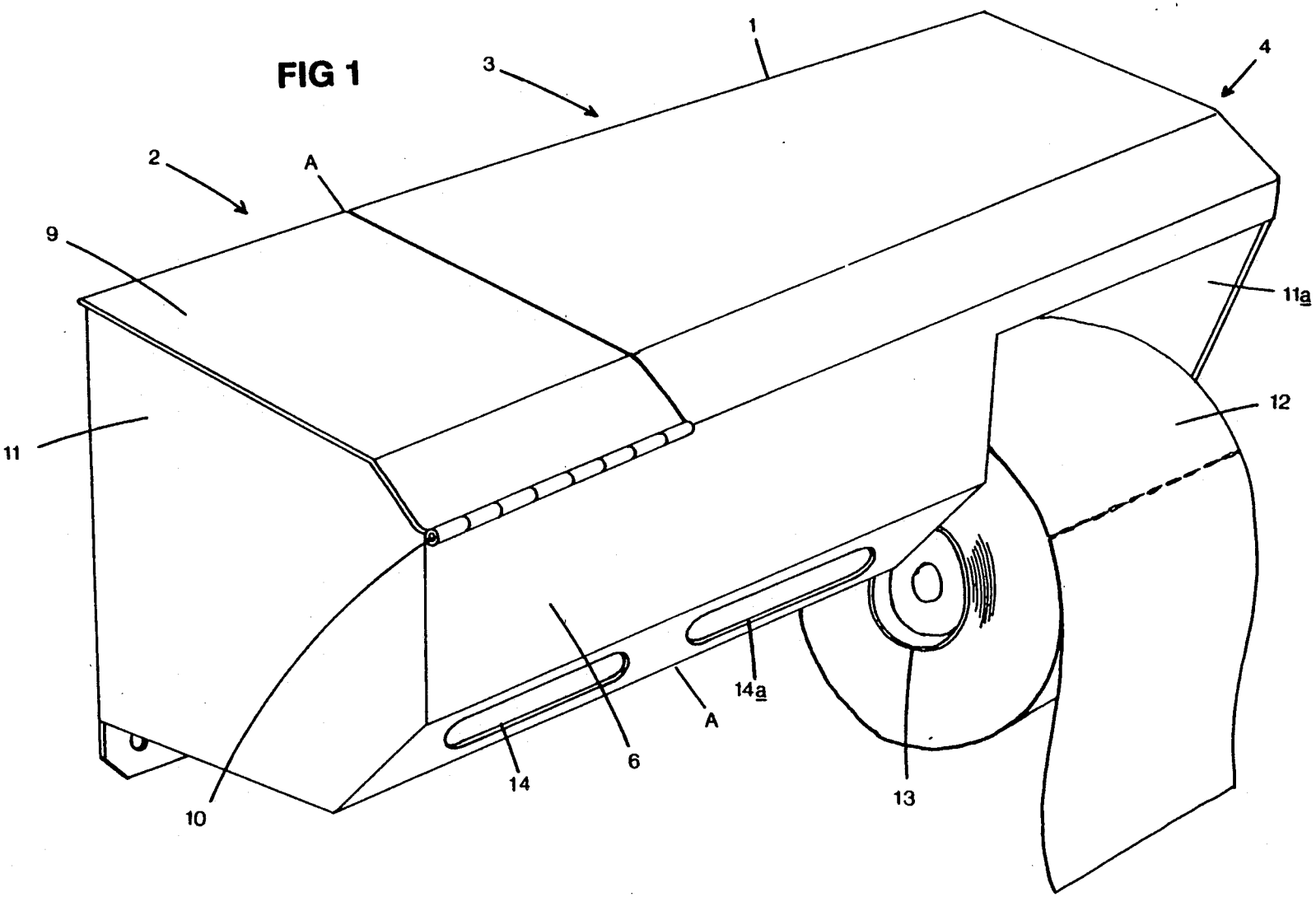
FIG. 1 is a perspective view of the dispenser.

In a preferred form of the invention, the toilet roll dispenser has a casing 1 which provides three compartments, these being a loading compartment 2, a magazine 3 and a dispensing compartment 4. The casing 1 also has a base 5, a front wall 6 and a rear wall 7 which is securable to a fixed wall 8 (see FIGS. 2, 3 and 4). A lid member 9 is pivoted at 10 to the front wall 6 of the casing 1 to provide access to the loading compartment 2. The casing also has a side wall 11 defining part of the loading compartment and a side wall 11*a* defining part of the dispensing compartment.

Figure 5:
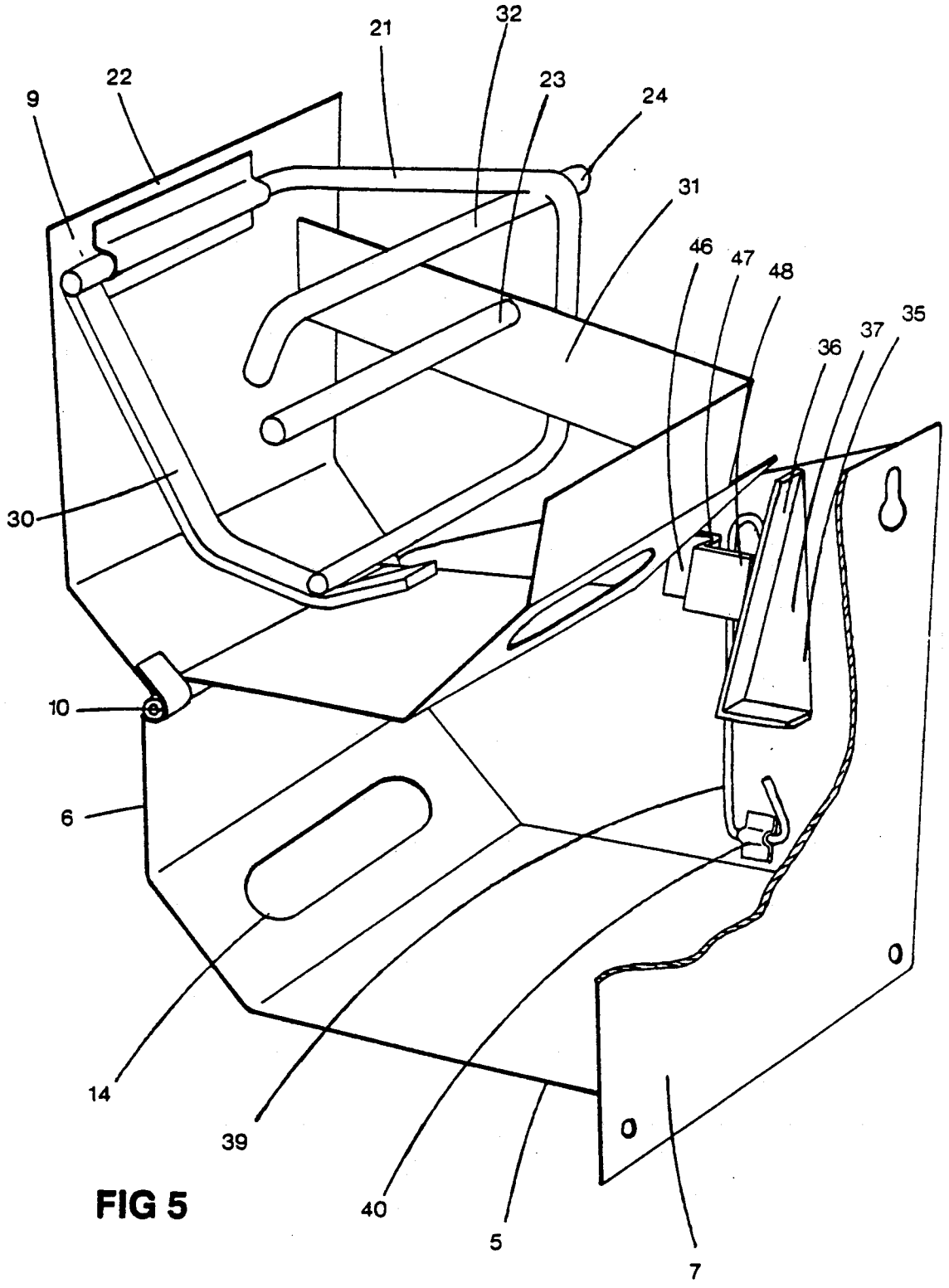
FIG. 5 is a three quarter perspective view in the direction of the arrows A—A of FIG. 1 of the loading compartment in an open condition.

A toilet roll 12 to be dispensed is inserted into the dispenser by placing it in the loading compartment 2. The toilet roll has a hollow core 13 formed of cardboard or the like as is well known. Access to the loading compartment is obtained by pivoting the lid member 9 from a closed position indicated in FIG. 2 to a fully open position indicated in FIG. 5. An aperture 14 to enable a toilet roll 12 to be manually moved from the loading compartment 2 into the magazine 3 is formed in the front wall 6. A similar aperture 14*a* is also formed in the front wall 6 of the casing 1 to enable a toilet roll 12 occupying the magazine 3 to be manually moved into the dispensing compartment 4 as will be hereinafter described.

Locking means is provided so that when a toilet roll 12 occupies the loading compartment 2, the lid member 9 is prevented from being opened to an extent that would allow a toilet roll to be removed from the loading compartment through the lid opening. The locking means which is more particularly shown in FIGS. 2 through 5, includes a cranked lever 21 pivoted by a bracket 22 to the lid member 9. A roll support member 23, the axis of which is substantially parallel to the longitudinal axis of the toilet roll dispenser, projects from a cross brace 31 fixed within the lid member 9. An auxiliary roll support member 32 extends from the cranked lever 21 substantially parallel to the roll support member 23, the distal end of said auxiliary roll support member having an upturn 26. A spigot 24, which may conveniently be an extension of the auxiliary roll support member 32, projects towards the side wall 11. When the roll support member 23 and the auxiliary roll support member 32 are in the relative position indicated in FIG. 2, the core 13 of the toilet roll 12 can slide onto the two roll support members 23 and 32.

A roll blocking arm 30 joins both ends of the cranked lever 21, the purpose of this arm being to allow the displacement of a toilet roll from the loading compartment into the magazine, but to resist the movement of a toilet roll from the magazine into the loading compartment.

Figure 3:
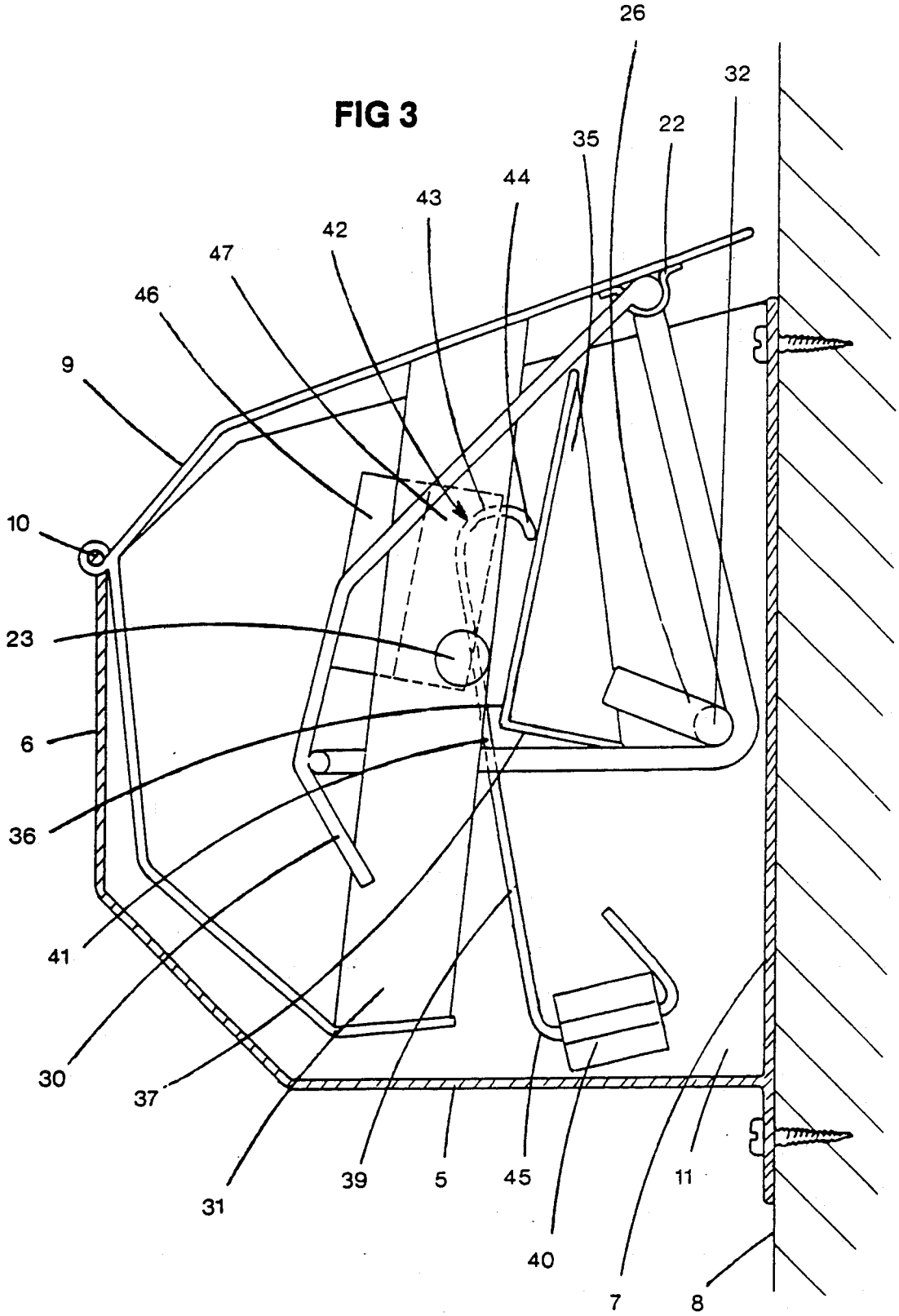
FIG. 3 is a view similar to that of FIG. 2 but without a toilet roll and with the lid member in a partly open position.
Figure 4:
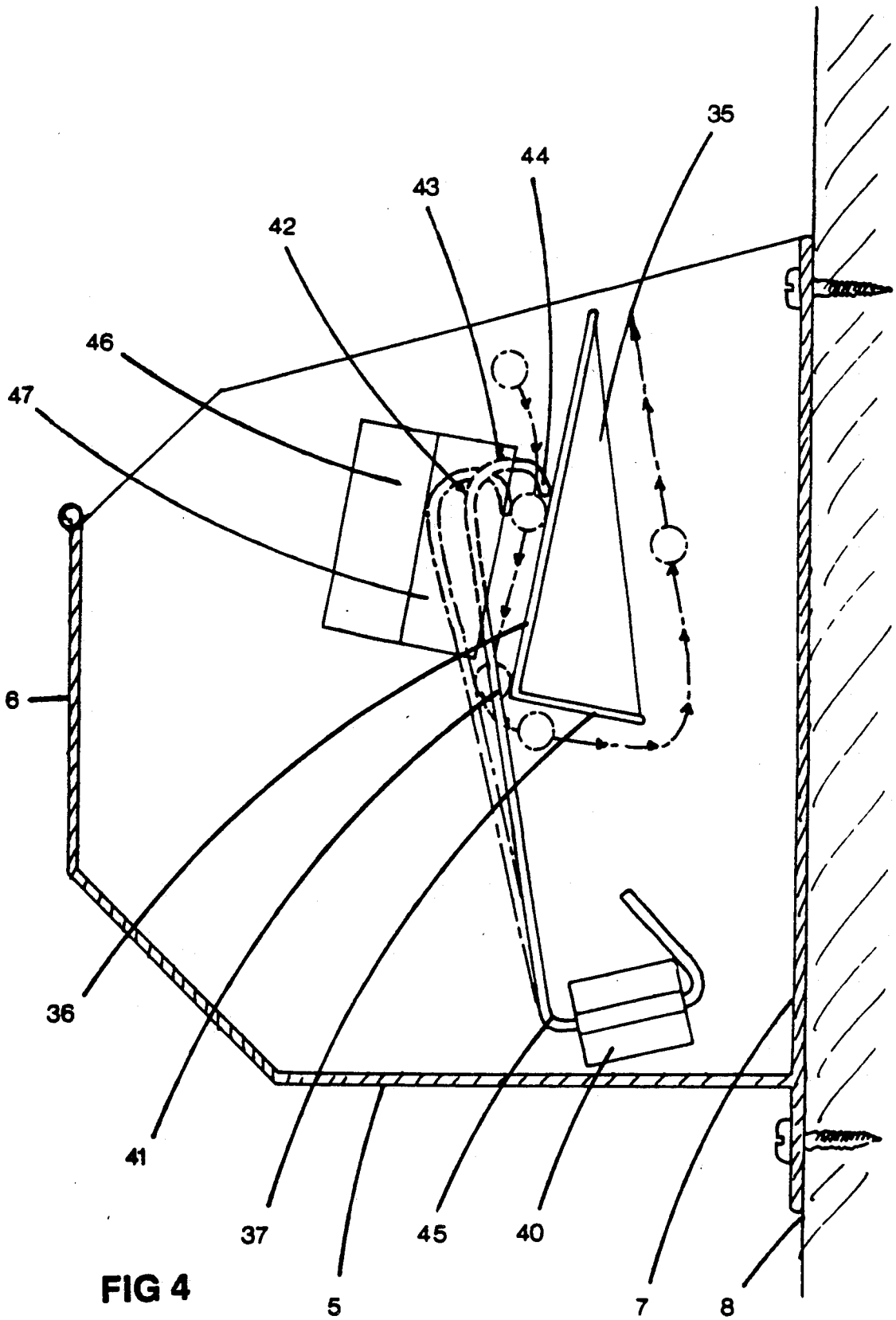
FIG. 4 is a view similar to that of FIG. 2 showing the locking means.

When the lid member 9 is in its closed position, and no toilet roll occupies the loading compartment 2, the cranked lever 21 will be free to pivot to its rest position, that is with the roll support member 23 and the auxiliary roll support member 32 being apart (see for instance FIG. 3). In such rest position, any attemped loading of a toilet roll that may be resident in the magazine 3 onto the two roll support members will be resisted, since the two roll support members are separated by a greater distance than the interior diameter of the core 13 of the roll 12.

The locking means also acts to prevent the lid member 9 from being pivoted from a closed position to an open position unless the cranked lever is in its rest position, and that position can only be attained if the loading compartment is free of a toilet roll.

More specifically, if there is no toilet roll in the loading compartment, the auxiliary roll support member 32 is free to pivot to the position indicated in full lines in FIG. 3. The lid member 9 may then be opened since the movement of the auxiliary roll support member 32 will follow the path indicated by the up arrows in FIG. 4, will be unrestricted. When the lid member 9 has been pivoted to its fully open position, the roll support member 23 and the auxiliary roll support member 32 will be in juxtaposition and a toilet roll may be engaged on the roll support members.

A stop lug (now shown in the drawings) projects from the side wall 11 so that it will be contacted by the lid member when in a fully open position and so restrain the lid member from being opened beyond that position. This will also prevent a toilet roll accommodated in the magazine, from being moved into and then withdrawn through the loading compartment.

Figure 2:
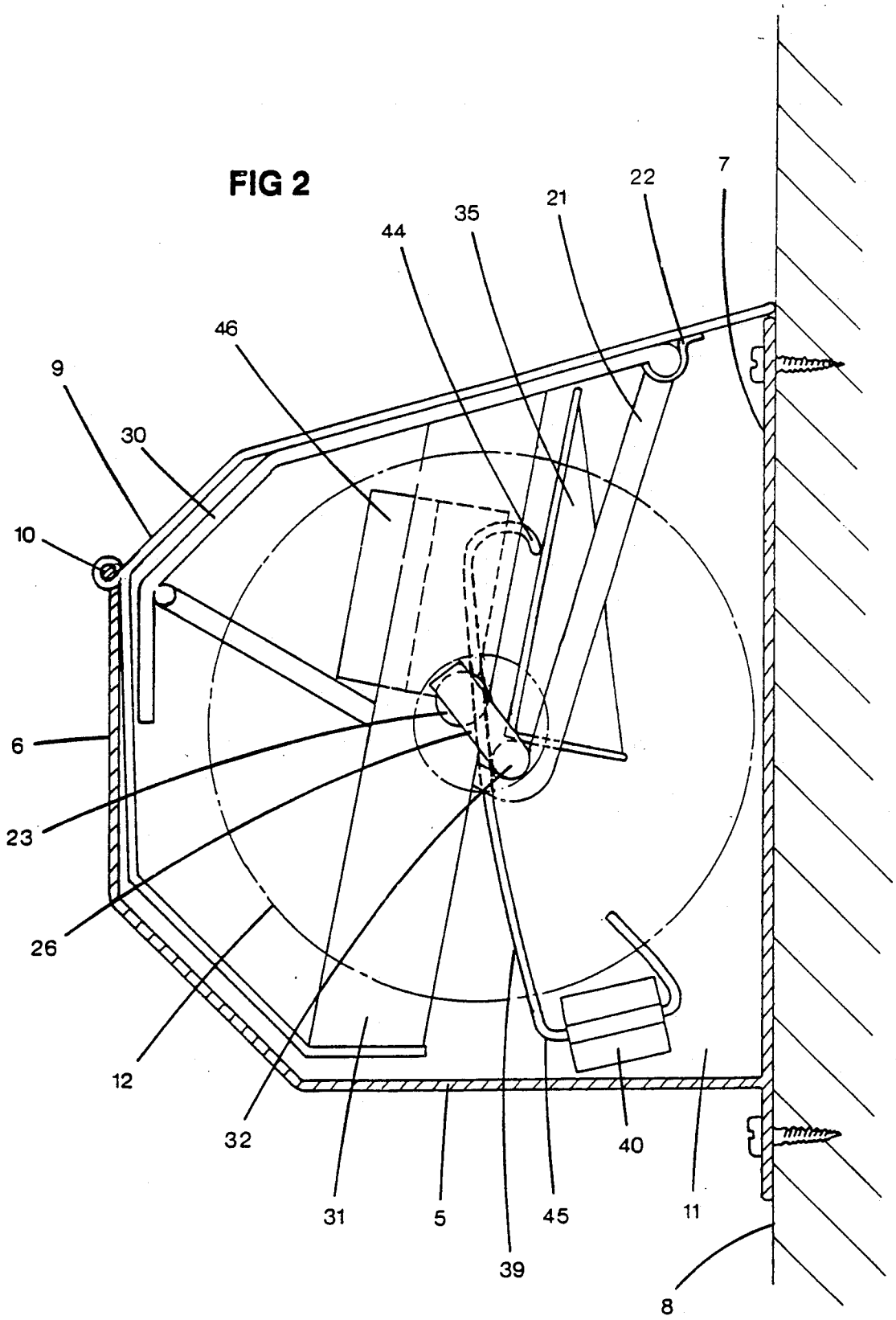
FIG. 2 is a view along the line A—A of FIG. 1 of the loading compartment together with a toilet roll (shown in broken lines) located within the compartment.

Once a toilet roll has been loaded onto the roll support member 23 and the auxiliary roll support member 32, these two members will be in juxtaposition, that is the position indicated in FIG. 2, and this will lock the lid member 9 and prevent it from being moved from its closed position. The mechanism to effect this locking, includes a stop member 35 firmly attached to the side wall 11, the stop member having a ramp 36 and an flange 37. A spring referenced generally at 39 has one end anchored by means of a saddle 40 to the side wall 11 and is shaped so that the central portion 41 of its shank is separated from the side wall 11. The other end of the shank is formed into a hook 43 which terminates in a peg 44 which bears against the side wall 11, while adjacent the end anchored by the saddle, the shank is kinked as at 45. A guard plate 46 is also attached to the side wall 11, this guard plate having a flanged portion 47 which is separated from the side wall by a distance piece 48. The distance between the flanged portion 47 and the side wall 11, is such that the hook 43 will be maintained between these two members but be free to move towards or away from the ramp, with the degree of movement being limited by the distance piece and the ramp 36 respectively. The spring is tensioned so that in its rest position, the head 42 of the spring will spring urged towards the ramp 36.

In operation, having engaged a toilet roll on the roll support members 23 and 32, the lid member may then be pivoted back to its closed position. During this closing movement, the spigot 24 will strike the head 42 of the hook 43 and will force it aside with the movement being guided by the guard plate 46. When the spigot has passed the head of the spring, the spring tension will force the head of the spring back against the ramp to obstruct reverse movement of the spigot and thereby prevent the lid member 9 being reopened. Further closing movement of the lid member 9 will force the spigot downwardly between the shank of the spring and the ramp and as the spigot nears the base of the ramp, because of the shape of the spring, the central portion of the shank of the spring will be bowed to force the spigot against the ramp. Additional downwards movement will result in the spigot clearing the ramp 36 and the spring pressure will then propel the spigot under the flange 37.

If an attempt is made to open the lid member 9 while a toilet roll is present in the loading compartment, the spigot 24 will contact the underside of the flange 37 and this will prevent any further opening movement of the lid member 9. If an attempt is made to force the spigot 24 towards the front of the casing in an endeavour to bypass the flange 37, any such movement will be resisted, since the spigot will come into contact the central portion 41 of the shank of the spring. Should sufficient pressure be exerted that the spigot deforms the shank of the spring, so that the spigot can ride up between the ramp and the shank of the spring, then the spigot will finally engage in the hook 43 to positively prevent further upwards movement.

After a toilet roll 12 has been loaded into the loading compartment it can be manually moved into the magazine 3 and if desired the lid member 9 of the loading compartment may then be opened and a further toilet roll loaded into the loading compartment. Access can be obtained through the aperture 14*a* to manually move the toilet roll from the magazine 3 into the dispensing compartment 4.

Figure 6:
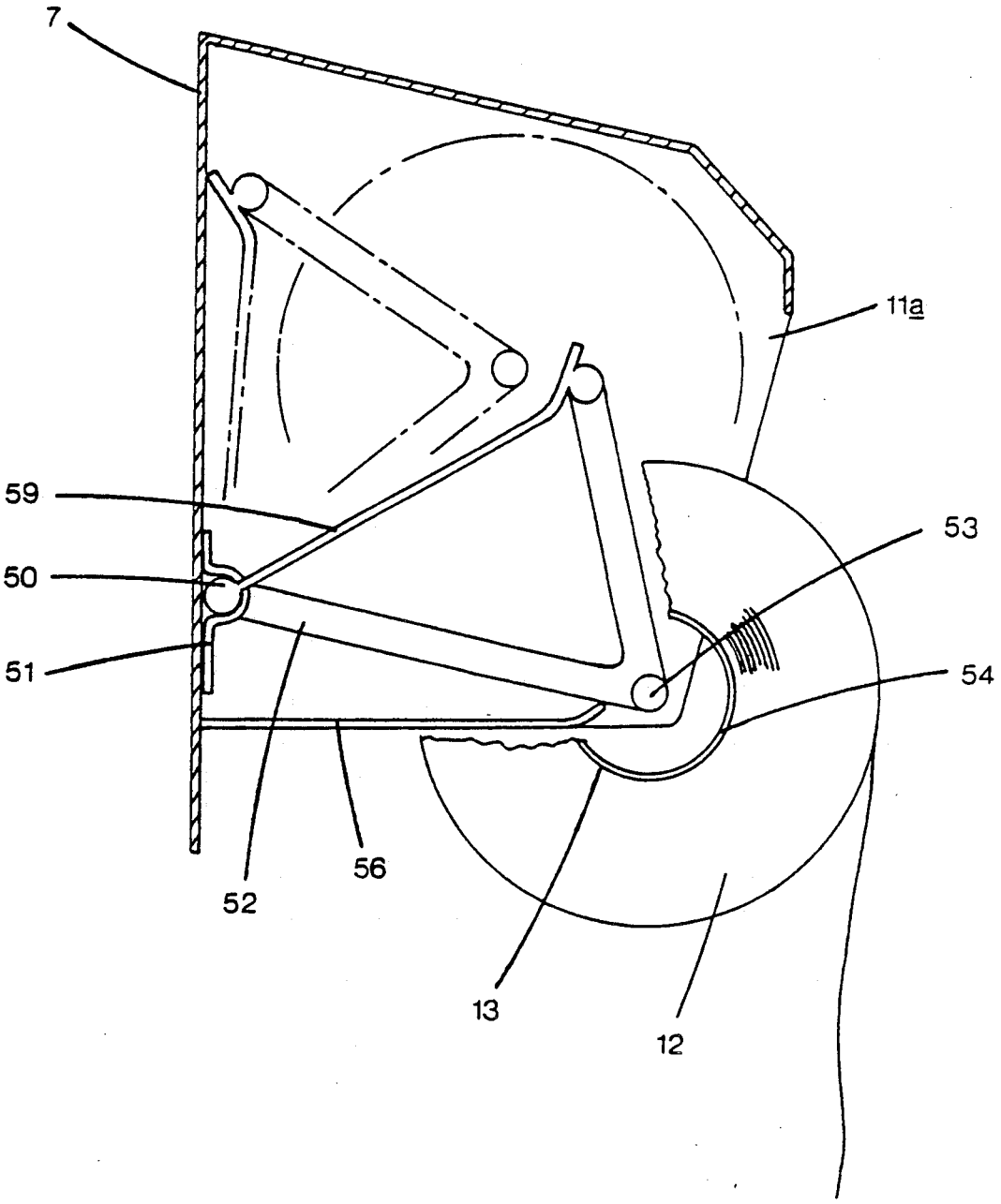
FIG. 6 is a view along the line A—A of FIG. 1 of the dispensing compartment.

The mechanism for dispensing paper from the toilet roll fulfills two functions. Firstly it prevents or at least minimizes the likelihood of a toilet roll being removed from the mechanism unless all or substantially all the paper has been first removed from the roll and secondly it acts as a form of brake to retard rotation of the toilet roll. One such mechanism is indicated in FIG. 6, wherein an arm 50 is pivotally secured to the rear wall 7 by means of a saddle member 51, the arm having an extension 52 from which a core support member 53 extends and which lies in a substantially parallel plane to the arm 50, with both the arm 50 and the core support member 53 having axes substantially parallel to the longitudinal axis of the dispenser. The core support member includes drum means 54 or similar so that the core of a toilet roll will be a desirably snug fit on the support member. Preferably friction means or the like is incorporated with the drum means so that the rotation of the drum 54 on the core support member will be frictionally retarded.

The pivotal movement of the dispensing mechanism on the bracket member 51 is limited by means of a ledge 56 or the like which projects from the side wall 11*a* of the dispenser and which will project into the path of the mechanism. The relative positioning of the ledge 56 and the contacting point with the dispensing mechanism is so arranged, that when the dispensing mechanism if swung into its fully open position, such as when a toilet roll is engaged on the mechanism and it is in its operating position, then the toilet roll can be removed from the drum only when all or substantially all the paper has been dispensed from the roll.

Means are also provided to resist the return of a toilet roll from the dispensing compartment into the magazine. One such means may consist in forming a lip or other form of restriction (not shown in the drawings) conveniently on the front wall 6 of the dispenser so as to restrict the area of the opening between the magazine and the dispensing compartment.

To load a roll onto the dispensing mechanism, the core support member 53 must be raised from the dispensing position indicated in full lines in FIG. 6 to the loading position indicated in broken lines in FIG. 6. When in the loading position, a roll 12 may be manually moved through the magazine, and slid onto the core support member 53. The core support member 53, with the roll, may then be allowed to fall to the dispensing position. When the core support member is in this position, a guard extension 59 will prevent a new roll from being slid from the magazine into the dispensing compartment. While in this position, the roll being dispensed can not be removed from the core support member 53 until all or substantially all, the paper has been dispensed, because as long as there is a significant amount of paper on the roll, the diameter of the roll will be too great to enable the roll to be withdrawn from under the base 5 of the casing.

The form of the invention previously described will enable three rolls of toilet paper to be held within the dispenser at one time. The dispenser can conveniently be manufactured with just a loading compartment and a dispensing compartment only, that is, it does not include a magazine. In another form the length of the magazine is increased so as to allow more than one roll to occupy the magazine at the same time. In addition, because of the nature of the mechanism, various diameters of toilet rolls can be accomodated in the dispenser, ranging from the smaller domestic sizes to the larger commercial sizes.

The toilet roll dispenser provided by this invention will enable ready access to be had to the loading compartment, provided the compartment does not already contain a toilet roll. When a toilet roll does occupy the loading compartment, then the lid member is automatically locked and consequently no other form of locking means such as keys and the like are required.

The foregoing describes a preferred form of the invention. Alterations and modifications as will be obvious to those skilled in the art are intended to be incorporated within the scope of the invention as defined in the appended claims.

I claim:

1. A toilet roll dispenser for dispensing toilet paper from a toilet roll comprising a casing having a loading compartment and a dispensing compartment, said loading compartment including a lid member openable to enable a toilet roll to be loaded into the loading compartment and including locking means to prevent the lid member from being opened while a toilet roll is present in the loading compartment, said locking means having a roll support member and an auxiliary roll support member which are moveable to a juxtaposed position to receive the toilet roll and which move to a separated condition when no toilet roll is present in the loading compartment, said auxiliary roll support member having a spigot which engages a stop member to prevent the lid member from being opened when the roll support member and the auxiliary roll support member are juxtaposed, said dispensing compartment being provided with a dispensing mechanism, said dispensing mechanism being moveable to a first position to receive a toilet roll from the loading compartment and moveable to a second position to enable paper to be dispensed from the toilet roll, and said dispensing mechanism being adapted so as to prevent removal of the toilet roll from the dispenser compartment until substantially all of the paper has been dispensed from the roll.

2. The toilet roll dispenser as claimed in claim 1, including a magazine which is situated between the loading compartment and the dispensing compartment and which is adapted to receive a toilet roll from the loading compartment.

3. The toilet roll dispenser as claimed in claim 1, having spring means which acts in conjunction with a ramp of said stop member to guide the spigot during the closing of the lid member to a locking position.

4. The toilet roll dispenser as claimed in claim 1, wherein the dispensing mechanism includes an arm pivotally secured to the casing of the dispenser, said arm including a core support member to receive a toilet roll when the mechanism is in its first position, the arm being pivotable to said second position to enable paper to be dispensed from the roll and to enable the toilet roll to be removed from the core support member and from the dispenser when substantially all the paper has been dispensed from the toilet roll.

5. The toilet roll dispenser as claimed in claim 4 wherein the core support member includes means to retard rotation of the toilet roll on the core support member.

* * * * *